US010058722B2

(12) United States Patent
Hopfe et al.

(10) Patent No.: US 10,058,722 B2
(45) Date of Patent: Aug. 28, 2018

(54) FIRE PROTECTION DEVICE AND METHOD FOR FIRE FIGHTING

(71) Applicant: APPARATEBAU GAUTING GMBH, Gauting (DE)

(72) Inventors: Karl Albrecht Hopfe, Dresden (DE); Gerd Wedler, Dresden (DE); Jan-Boris Philipp, Munich (DE); Alexander Rosam, Gilching (DE)

(73) Assignee: APPARATEBAU GAUTING GMBH, Gauting (DE)

( * ) Notice: Subject to any disclaimer, the term of this patent is extended or adjusted under 35 U.S.C. 154(b) by 289 days.

(21) Appl. No.: 14/624,996

(22) Filed: Feb. 18, 2015

(65) Prior Publication Data

US 2016/0236024 A1 Aug. 18, 2016

(51) Int. Cl.

| | |
|---|---|
| ***A62C 35/68*** | (2006.01) |
| ***A62C 5/00*** | (2006.01) |
| ***A62C 35/02*** | (2006.01) |
| ***A62C 99/00*** | (2010.01) |
| ***A62C 3/08*** | (2006.01) |

(52) U.S. Cl.

CPC ..... *A62C 35/68* (2013.01); *A62C 5/002* (2013.01); *A62C 35/023* (2013.01); *A62C 99/0018* (2013.01); *A62C 3/08* (2013.01)

(58) Field of Classification Search

CPC ..... A62C 3/08; A62C 5/002; A62C 5/008; A62C 35/023; A62C 35/68; A62C 99/0018

USPC ..... 169/9, 15, 46, 62

See application file for complete search history.

(56) References Cited

U.S. PATENT DOCUMENTS

| | | | | |
|---|---|---|---|---|
| 5,799,735 | A * | 9/1998 | Sundholm | A62C 5/022 169/13 |
| 5,845,714 | A * | 12/1998 | Sundholm | A62C 3/00 169/11 |
| 6,173,790 | B1 * | 1/2001 | Russwurm | A62C 99/0072 169/15 |
| 2005/0173131 | A1 * | 8/2005 | Dunster | A62C 99/0072 169/44 |
| 2010/0132963 | A1 * | 6/2010 | Sprakel | A62C 35/023 169/46 |
| 2010/0294518 | A1 * | 11/2010 | Lelic | A62C 99/0018 169/9 |
| 2011/0259617 | A1 * | 10/2011 | Lelic | A62C 31/05 169/46 |
| 2012/0168184 | A1 * | 7/2012 | Enk, Sr. | A62C 3/08 169/14 |

FOREIGN PATENT DOCUMENTS

EP 1 293 230 A1 3/2003

* cited by examiner

*Primary Examiner* — Jason Boeckmann
*Assistant Examiner* — Cody Lieuwen
(74) *Attorney, Agent, or Firm* — Scully Scott Murphy and Presser

(57) ABSTRACT

The present invention especially relates to a fire protection system (1) with a wetting system (23) which is designed and equipped for the wetting of a predetermined extinguishing volume (11) with extinguishing water, wherein the wetting system (23) is designed and equipped in such a way that in a pure water-gas extinguishing measure within a defined operating envelope the concentration of extinguishing gas in the extinguishing volume remains below the extinguishing concentration.

12 Claims, 5 Drawing Sheets

FIRE PROTECTION DEVICE AND METHOD FOR FIRE FIGHTING

BACKGROUND OF THE INVENTION

The invention relates especially to a wetting system for fire protection systems and also to a method for fire fighting.

DISCUSSION OF THE PRIOR ART

Fire protection systems and devices and corresponding methods are known, both for buildings and for modes of transport, such as aircraft. In contrast to buildings, the provision of an effective fire protection, especially in aircraft, is made difficult to the effect that due to the restricted space and weight ratios extinguishant, especially liquid extinguishant, cannot be provided or carried along to an unlimited degree.

Particularly for the aforesaid reasons, it is desirable especially in the case of aircraft to be able to provision for fire protection systems which on the one hand are optimized with regard to the overall weight, and which on the other hand still enable a comparatively effective and efficient fire protection.

SUMMARY OF THE INVENTION

It is therefore especially the object of the invention to provide a way of being able to provide an especially effective and efficient, and at the same time weight-optimized, fire protection system for aircraft. In particular, a wetting system for corresponding fire protection systems or fire extinguishing installations, a fire protection system, and also a method for fire fighting are to be made available.

The present invention relates especially to a wetting system or wetting unit for fire protection installations or fire protection systems which is designed and equipped for the wetting of a predetermined, restricted or closed, defined especially by at least one space, extinguishing volume with a liquid extinguishant, especially an extinguishing liquid, preferably extinguishing water or extinguishing water or agent mixed with organic and/or inorganic salts, wherein the wetting system is designed and equipped in such a way that in a pure liquid-gas extinguishing measure, especially a pure water-gas extinguishing phase, within a defined operating envelope the concentration of extinguishing gas in the restricted or closed extinguishing volume remains below the extinguishing concentration. The wetting system is especially to be dimensioned or scaled in such a way that in the case of pure liquid-gas extinguishing within the operating envelope the concentration of extinguishing gas in the correlated extinguishing volume remains below the extinguishing concentration. Boundary conditions and parameters, especially environmental parameters such as air pressure, temperature, etc., under which the wetting system is operated when in use, are especially to be covered by the operating envelope.

In other words, the effect achieved in the case of the wetting unit is that during extinguishing operation of the wetting unit in the case of pure liquid-gas extinguishing, i.e. in an extinguishing measure in which an extinguishing liquid-gas mixture is introduced into the extinguishing volume via the wetting unit, just enough extinguishing gas is introduced into the extinguishing volume by means of the extinguishing liquid-gas mixture so that the extinguishing concentration is still fallen short of.

For the proposed wetting system, this is therefore especially adapted to the predetermined extinguishing volume, for example to a cargo hold or other space in an aircraft, especially correlated with this in such a way that the operation according to the invention is possible, in which operation in the case of pure extinguishing liquid-gas mixture-based extinguishing the extinguishing concentration is still fallen short of.

The introduction of extinguishing gas into the extinguishing volume for the purpose of achieving the extinguishing concentration can be carried out by means of separate extinguishing units which, for example, can be designed so that extinguishing gas can be introduced into the extinguishing volume independently of the wetting system or wetting unit.

The combination consisting of wetting system and extinguishing volume, or the at least one space defining the extinguishing volume, can be defined as a flameproof or fireproof spatial unit, wherein the wetting system is adapted to the extinguishing volume, i.e. to the at least one space, so that in the case of extinguishing with a liquid-gas mixture in the extinguishing volume, the concentration of extinguishing gas in the extinguishing volume remains below the extinguishing concentration. This shall especially apply when the extinguishing volume, such as a cargo hold or another space, is formed by a space surrounded by walls or a volume surrounded or enclosed or terminated by walls. The spatial unit can have a plurality of spaces, or individual spaces, or volumes, which are separated from each other and surrounded by walls. In this case, the wetting system is preferably designed in such a way that the condition that the concentration of extinguishing gas remains below the extinguishing concentration applies to each of the individual spaces.

As already mentioned, the extinguishing volume can be defined by one or more restricted, especially closed, spaces or by a single space. The space, or the spaces, can especially be one or more cargo holds in an aircraft.

The wetting system or wetting unit is designed and equipped to at least partially wet the predetermined extinguishing volume, e.g. one or more spaces protected by the fire protection system against fires. In other words, the wetting system is especially designed for introducing the extinguishing liquid into the extinguishing volume in order to at least partially wet the interior of the extinguishing volume and/or objects located therein. As a result of a wetting with extinguishing liquid, in the event of fire a comparatively rapid, at least partial extinguishing can be achieved and/or the spread of an established fire can be at least contained, wherein by means of the extinguishing liquid an especially distinct cooling of the extinguishing volume can be achieved.

The proposed wetting system can especially be of a scalable design in such a way that this can be adapted in its overall construction to different sizes and characteristics of the extinguishing volume, especially of the one or more spaces of the extinguishing volume. In one respective realization, a wetting system is scaled in its respective function to the volume which is to be extinguished, i.e. to a predetermined extinguishing volume, and is adapted to the predetermined extinguishing volume.

The proposed wetting system comprises one, i.e. at least one, liquid extinguishant tank which is designed for storing the liquid extinguishant. The wetting system furthermore comprises one, i.e. at least one, compressed gas accumulator which is designed for the pressurized storage of extinguishing gas. The compressed gas accumulator can comprise, for example, one, i.e. at least one, compressed gas bottle in which the extinguishing gas is stored under pressure. The extinguishing gas is a gas which generates a smothering effect, i.e. reduces the oxygen concentration in the extinguishing volume. The extinguishing gas can especially be an inert gas, such as nitrogen.

The wetting system furthermore comprises a piping system which is designed and equipped for introducing a liquid-gas mixture, comprising at least a first proportion of liquid extinguishant and a second proportion of extinguishing gas, into the extinguishing volume via at least one discharge opening. The discharge opening can especially be considered to be a component part of the piping system.

In the proposed wetting system, the liquid extinguishant tank and the compressed gas accumulator are interconnected via the piping system. The connecting of the compressed gas accumulator and the liquid extinguishant tank can especially be in such a way that the liquid extinguishant tank is directly connected to a section—especially a partial volume which in itself is closed off—of the overall compressed gas accumulator. In this case, the volume section of the compressed gas accumulator which is not covered by the partial volume can be connected to the piping system without this volume section being connected, especially directly, to the liquid extinguishant tank.

The liquid extinguishant tank and the compressed gas accumulator are also designed in such a way that these feed a mixing point of the piping system which is equipped and designed for producing the liquid-gas mixture—especially consisting of a first proportion of liquid extinguishant and a second proportion of extinguishing gas—and is connected upstream to the at least one discharge opening. The mixing point can especially be connected to the compressed gas accumulator so that extinguishing gas would be able to be fed to this mixing point directly from the compressed gas accumulator. Furthermore, the mixing point can be connected to the liquid extinguishant tank so that liquid extinguishant, pressurized as a result of this connection to the compressed gas accumulator, can be fed directly to this mixing point.

The mixing point can be designed and arranged so that extinguishing gas fed into this from the compressed gas accumulator and liquid extinguishant fed from the liquid extinguishant tank are mixed in a predetermined ratio. The mixing point can especially be designed so that during operation of the wetting system a 2-phase mixture consisting of extinguishing gas and liquid extinguishant, preferably with a predetermined composition is introduced into an extinguishing pipe of the piping system which is located between the mixing point and the discharge opening. In other words, the liquid-gas mixture which is generated at the mixing point can be fed, via the extinguishing pipe which can form a branch of the piping system, to the discharge opening from where the mixture can be introduced into the extinguishing volume.

According to the invention, the wetting system, especially the liquid extinguishant tank, the compressed gas accumulator and the mixing point, is designed and arranged in such a way that in a pure liquid-gas extinguishing measure, especially in the case of exclusive introduction of the liquid-gas mixture, within the defined or predetermined operating envelope the concentration of extinguishing gas in the extinguishing volume remains below the extinguishing concentration.

To be understood by the defined or predetermined operating envelope is in this case especially an operation under the following boundary conditions in the extinguishing volume: pressure: 0.75 to 1.10 bar, temperature: −40 to +70° C.

The liquid-gas extinguishing measure within the operating envelope is preferably also an operation in which the liquid-gas mixture is fed continuously to the extinguishing volume, especially over a duration up to the complete or almost complete emptying of the liquid extinguishant tank.

With a wetting system designed in such a way, an especially effective and efficient introduction of the liquid extinguishant and wetting of the extinguishing volume can be achieved, wherein the overall quantity of extinguishing gas or inert gas can be significantly reduced in comparison to known systems. The use of a smaller volume of extinguishing gas, especially in such a way that the extinguishing gas concentration is not achieved, can have the effect that the expansion coldness created as a result of (adiabatic) expansion of the extinguishing gas from the compressed gas accumulator and introduced with the extinguishing gas into the piping system, can be limited so that the liquid extinguishant, especially extinguishing water, does not freeze during the liquid-gas extinguishing measure. In other words, within the operating envelope in a liquid-gas extinguishing measure, especially in the case of complete emptying of the liquid extinguishant tank into the extinguishing volume with continuous liquid extinguishant-gas mixture production, an ice build-up caused by expansion coldness of the extinguishing gas in the liquid-gas mixture can be avoided. Icing caused by expansion coldness can lead to the piping system and/or outlet openings or discharge openings becoming blocked, especially iced up and/or frozen, so that the wetting would be interrupted. This would constitute a serious defect especially in the field of air travel.

If, however, the quantity of extinguishing gas which is added to the liquid extinguishant at the mixing point is selected so that the extinguishing concentration in the extinguishing volume is not achieved, then on account of the comparatively small quantities of extinguishing gas used for the wetting as such, i.e. in the case of the liquid-gas extinguishing measure, icing within the operating envelope can be reliably avoided.

In order to still achieve a liquid-gas extinguishing concentration in the extinguishing volume which lies within the region of the extinguishing concentration or above the extinguishing concentration, it can be provided in the proposed wetting system that extinguishing gas is introduced into the extinguishing volume via a separate piping system or a separate piping segment and/or via separate gas discharge openings, e.g. gas nozzles. Consequently, in addition to the pure liquid-gas extinguishing measure provision can be made for a pure gas extinguishing measure which is superimposed on this and/or downstream to this and by means of which the respective extinguishing concentration of extinguishing gas in the extinguishing volume can be adjusted.

In embodiments, it can be provided that the piping system comprises at least one pressure- and/or volume limiting element connected upstream to the mixing point by means of which the pressure or the pressure distribution and/or the volumetric flow of extinguishing gas is adjusted in such a way that the concentration of extinguishing gas in the extinguishing volume during the pure liquid-gas extinguishing measure or phase remains below the extinguishing concentration. The pressure- or volume limiting element can be selected and/or adjusted in accordance with the size of the extinguishing volume. A comparatively simple scaling to different extinguishing volumes is especially possible in this way.

In embodiments, it can be provided that the at least one pressure- and/or volume limiting element, for example a restrictor, is, or are, designed in such a way that the liquid-gas mixture has a composition consisting of 50 wt. % to 70 wt. % of liquid extinguishant and 30 wt. % to 50 wt. % of extinguishing gas so that for example in the liquid-gas extinguishing measure 80 g to 300 g of extinguishing water mixed with 60 g to 230 g of nitrogen can be introduced per cubic meter of extinguishing volume. In one exemplary embodiment, for example in the case of a more economical extinguishing, 80 g of extinguishing water together with 60 g of nitrogen per $m^3$ can be introduced in this case. In the case of moderate extinguishing, for example 170 g of extinguishing water together with 120 g of nitrogen per $m^3$ can be introduced. In order to achieve an even more enhanced extinguishing effect, for example 300 g of extinguishing water together with 230 g of nitrogen per $m^3$ can be introduced. Especially for the referenced extinguishing modes, the extinguishing concentration of extinguishing gas in the extinguishing volume is not achieved, and it has been shown for the referenced modes that within the operating envelope icing or ice build-up in the piping system caused by expansion coldness can be avoided.

In embodiments, it can be provided that the at least one pressure- and/or volume limiting element is, or are, designed in such a way that the extinguishing gas pressure in the piping system lies in the region of between 8 bar and 30 bar. Such pressures have proved to be especially advantageous for the extinguishing conditions under reduced nitrogen supply proposed herein in the case of liquid-gas extinguishing, especially to the effect that an advantageous gas-extinguishing liquid thorough mixing is achieved.

In embodiments of the wetting system, it can be provided that provision can furthermore be made for an additional piping system which is connected to the compressed gas accumulator and is preferably different from the piping system. The additional piping system can be designed and equipped in corresponding embodiments in such a way that extinguishing gas is exclusively introduced, or can be exclusively introduced, into the extinguishing volume via gas outlet openings. The additional piping system can especially be used in order to raise the concentration of extinguishing gas to the extinguishing concentration in a temporally parallel, temporally overlapping and/or temporally consecutive manner with regard to the pure liquid-gas extinguishing measure which is constructed with the piping system described further above, and to maintain the extinguishing concentration, at least for a certain time period. Via the additional piping system, comparatively larger quantities of extinguishing gas can be introduced.

By separating the additional piping system from the extinguishing liquid-based liquid-gas piping system, it can achieve the effect that the expansion coldness generated in the case of the pure gas extinguishing is not introduced into the piping system of the liquid-gas extinguishing measure. Therefore, for example icing and/or ice forming in the liquid-gas system and partial system failures associated therewith can be avoided.

In further embodiments, it can be provided that the compressed gas accumulator comprises at least two compressed gas tanks, wherein the piping system, especially also the liquid extinguishant tank, can be fed from a first compressed gas tank, and wherein the additional piping system is fed from a separate, second compressed gas tank which is not connected to the first compressed gas tank. An advantage of separating the two extinguishing modes, i.e. pure gas extinguishing and pure liquid-gas extinguishing, is that the individual extinguishing measures, i.e. gas extinguishing and liquid-gas extinguishing, can in the main be initiated and/or terminated independently of each other. In case one of the sub-systems fails, a containment or extinguishing of the fire is also possible by means of the other system. For gas extinguishing, there are other optimum nozzle positions as for water mist. Water mist nozzles should be attached on the ceiling of the extinguishing volume at equal distances in order to achieve an equal distribution of the water mist in the volume. Gas discharge openings, however, should be installed as far away as possible from leakage sources such as freight doors or pressure compensation openings so that the residence time of the gas in the extinguishing volume is as long as possible. The separation of water mist outlet openings and gas outlet openings, as is possible with the architecture proposed herein, allows in each case an optimum positioning of respective outlet openings for gas and extinguishing liquid in accordance with the physical principle of operation of the extinguishant. It is also to be noted that in case the extinguishing volume consists of a plurality of separate sub-volumes, different extinguishing measures can be initiated for different sub-volumes. A further advantage of the realization of a system with the two extinguishing measures which can be operated independently of each other is that improved thermodynamic effects in the extinguishing volume can be achieved, and the effect of an improved distribution of the extinguishing gas in the extinguishing volume is especially achieved. In particular, it is possible that number and position or location of the discharge openings and outlet openings for the liquid-gas mixture on the one hand and for the extinguishing gas on the other hand can be selected and adapted in accordance with the respective conditions of the extinguishing volume. The provision of the two independently operable extinguishing measures also improves the system safety and reliability as a result of redundancy.

In further embodiments of the wetting system, it can be provided that the compressed gas accumulator comprises a plurality of interconnected compressed gas tanks which together feed the piping system, the liquid extinguishant tank and the additional piping system. Such embodiments are especially advantageous when a division into different compressed tanks corresponding to the respective scaling requirements is not possible, or possible only with expenditure. When using a standard compressed gas accumulator, especially in the form of interconnected compressed gas tanks, by suitable positioning and design of pressure- and/or volume limiting elements it can achieve the effect that the condition described further above for the pure liquid-gas extinguishing within the operating envelope is achieved, i.e. that the extinguishing concentration is not achieved, or that the concentration of extinguishing gas in the extinguishing volume remains below the extinguishing concentration.

In the case of the at least partial simultaneous execution of the pure gas extinguishing and the pure liquid-gas extinguishing, the extinguishing concentration can already be achieved before the end of the liquid-gas extinguishing. However, the extinguishing concentration, in accordance with the underlying invention, is not generated as a result of the pure liquid-gas extinguishing.

In embodiments, it can be provided that the liquid extinguishant tank comprises a separate compressed gas accumulator associated with this for the pressurized introduction of the liquid extinguishant into the piping system. In this case, the mixing point can be fed from another compressed gas tank. The compressed gas tank which is associated with the liquid extinguishant tank can be designed so that the liquid extinguishant tank can be completely emptied with pressure application.

The wetting system proposed herein can especially be used with fire protection systems. Thus, in accordance with patent claim 8 a fire protection system, especially for use and installation in aircraft, can comprise a fire protection system corresponding to one of the previously described embodiments.

In embodiments, the fire protection system can furthermore comprise a gas extinguishing system which can be designed for exclusively introducing extinguishing gas into the extinguishing volume in such a way that an at least fire-retarding extinguishing concentration of extinguishing gas is achieved in the extinguishing volume.

Concerning advantages and advantageous effects of the fire protection system, reference is made to the embodiments for the wetting system which shall correspondingly apply here.

A further aspect of the invention relates to a method for fire extinguishing or fire fighting in an extinguishing volume in aircraft, using the wetting system or fire protection system proposed herein. As extinguishing volumes, especially one or more cargo holds in aircraft are a possibility.

In the case of the method, in one fire fighting measure a liquid-gas mixture consisting of liquid extinguishant, especially extinguishing water, or extinguishing water or liquid extinguishant mixed with organic and/or inorganic salts, and extinguishing gas can be introduced into the extinguishing volume, wherein the introduction of the liquid-gas mixture is adjusted in such a way that as a result of the pure liquid-gas extinguishing within the operating envelope the concentration of extinguishing gas in the extinguishing volume remains below the extinguishing concentration of the extinguishing gas, i.e. in such a way that the extinguishing concentration is not achieved as a result of the pure liquid-gas extinguishing measure. In this way, an adequate wetting of the extinguishing volume with liquid extinguishant can be achieved. Furthermore, it achieves the effect that within the operating envelope an ice formation or icing up of liquid extinguishant, especially extinguishing water, in and/or on the piping system of the wetting system is avoided. Concerning advantages and advantageous effects of the method, reference is made to the above embodiments.

For the term, and for meaning of the term, extinguishing volume, reference is made to the embodiments further up. The extinguishing volume can especially be formed by one or more spaces enclosed or surrounded by walls. Similarly, with regard to the term "operating envelope" reference is made to the description specified further up, which correspondingly applies here.

In embodiments of the method, a further fire fighting measure, in which extinguishing gas is exclusively introduced into the extinguishing volume via a further piping system, can be initiated and/or activated at the same time as, in a temporally overlapping manner with and/or temporally after the fire fighting measure.

The use of the pure extinguishing gas-based extinguishing does not contradict the above description of the invention even during the liquid-gas extinguishing measure, because according to the invention it is proposed that the wetting system is adjusted and designed so that within the operating envelope for the pure liquid-gas extinguishing the extinguishing concentration of extinguishing gas is not achieved. The wetting system which is adjusted in this way is correspondingly operated if extinguishing gas is additionally introduced into the extinguishing volume at the same time or in a temporally overlapping manner via the additional piping system.

Consequently, in the case of the extinguishing method according to the invention it can be provided that via the liquid-gas extinguishing a wetting of the extinguishing volume is carried out, whereas via the pure gas-based extinguishing the concentration of extinguishing gas can be increased to the extinguishing gas concentration. After input of the entire liquid extinguishant supply into the extinguishing volume a purely extinguishing gas-based extinguishing can be continued, for example by extinguishing gas being introduced into the extinguishing volume via the additional piping system, or via the additional piping system and the piping system which is provided for liquid-gas extinguishing, especially water-gas extinguishing, so that the extinguishing concentration can be achieved at a certain point in time and maintained after this point in time.

Embodiments of the method are also especially gathered from the embodiments of the wetting system proposed herein or the fire protection system proposed herein.

BRIEF DESCRIPTION OF THE DRAWINGS

Exemplary embodiments of the invention are described below based on concrete exemplary embodiments in conjunction with the attached figures. In the drawing

Providing nothing to the contrary ensues from the subsequent description, the same, or functionally the same, elements in the figures are identified by the same designations.

DETAILED DESCRIPTION OF THE INVENTION

Figure 1:
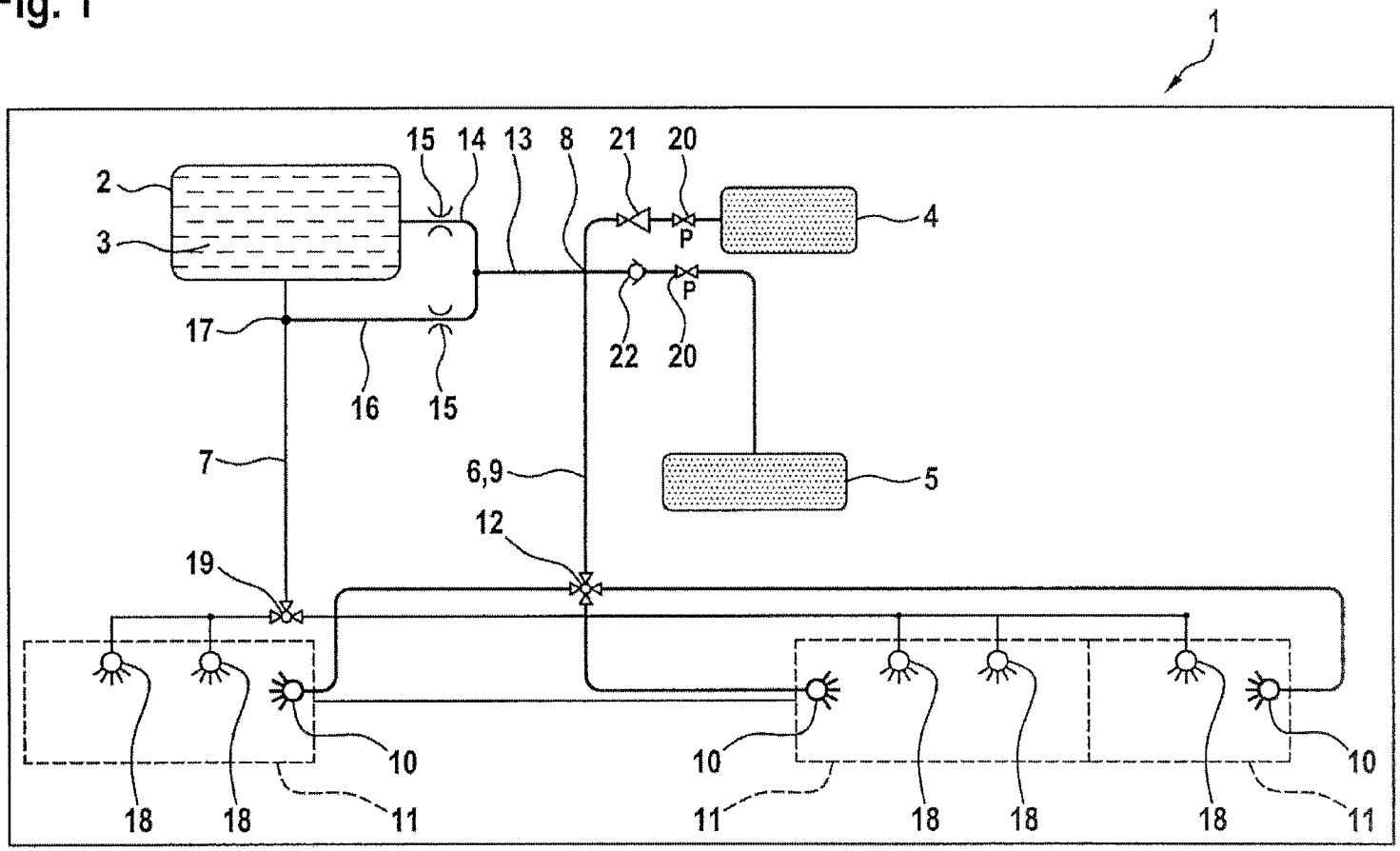
FIG. 1 shows a schematic construction of an exemplary first embodiment of a fire protection system proposed herein for aircraft.

FIG. 1 shows a schematic construction of an exemplary embodiment of a fire protection device 1 proposed herein for aircraft, especially for extinguishing volumes or spaces in aircraft, such as cargo holds, lounges, cabins, etc.

In the case of a fire protection device in the sense of the present invention, it can especially be a device by means of which emerging or already established fires or flames can be suppressed or extinguished, or by means of which the emergence and/or spread of fires and/or flames can be counteracted.

The fire protection device can comprise at least one liquid extinguishant tank 2 or extinguishing water tank which is designed for receiving and holding a liquid extinguishant, i.e. an extinguishing liquid, especially extinguishing water.

A medium which in liquid or liquid-flowable form is suitable for extinguishing or suppressing fires shall especially be understood by a liquid extinguishant. The liquid extinguishant can especially be a liquid extinguishant of class A fires. The liquid extinguishant in some circumstances can also be or comprise a medium of class B fires. Especially water or water with additives come into consideration as a liquid extinguishant in embodiments of the invention. Possible additives of corresponding embodiments are especially organic and/or inorganic salts, such as $CaCl_2$, $CH_3COOK$ or $CHKO_2$.

The fire protection device can also be equipped with an extinguishing gas source 4, 5, especially an inert gas source, which can be designed for providing, for producing or for storing an extinguishing gas in a pressurized state. The extinguishing gas source 4, 5 can be designed for the provision, production and/or for the stored provision of an inert gas.

The term inertising shall especially mean in this case that the extinguishing gas has at least one fire or flame retarding and/or suppressing effect. The inertising gas can be nitrogen gas or a low-oxygen gas mixture, for example. The inertising gas or inert gas can be nitrogen or another low-oxygen gas. In any case, the inertising gas should be suitable for lowering the oxygen content in a fire-endangered and/or flame-endangered space at least below the oxygen content which is required for combustion reactions.

The inert gas source in embodiments can especially comprise a compressed gas source, for example a pressure accumulator or compressed gas accumulator, for example in the form of one or more compressed gas bottles 4. It is also possible that the inert gas source in embodiments comprises one or more devices for the continuous production of inertising gas, or is connected to such a device.

The proposed fire protection device 1 in embodiments can furthermore comprise at least one first piping system 6 which is connected to the outlet of the inert gas source. The first piping system 6 can be designed and equipped for introducing the inertising gas of the at least one inert gas source 4, 5 via a first pipe branch 9 into at least one space 11 of the aircraft.

For introducing the inertising gas into the space, the first piping system 6 can comprise outlet openings 10 at the pipe ends which open into the respective space, which outlet openings 10 are designed for introducing the inertising gas into the respective space 11. By the introduction of the inert gas, an atmosphere, which has at least a fire-retarding and/or flame-retarding effect, can be produced, adjusted and/or maintained in the respective space 11.

Exposing the space to inertising gas, especially in a piping system designed in addition thereto, is a way which can be realised by the proposed system and is especially effective for the rapid fighting or suppression of fire and/or flame situations on board an aircraft or another mode of transport. As has already been mentioned further above, the effect of the liquid-gas-based extinguishing being able to be carried out essentially without technical difficulties can be achieved.

In addition to the first piping system, the fire protection device in embodiments can furthermore comprise a second piping system 7 to which is connected the liquid extinguishant tank 2 and/or into which is integrated the liquid extinguishant tank 2. The second piping system 7 can be coupled or connected to the outlet of the inert gas source 4, 5 via a second pipe branch 13 of the first piping system 6. The second piping system 7 is designed for introducing a 2-phase mixture consisting of liquid extinguishant and inertising gas into the at least one space or extinguishing volume 11, especially cargo hold.

The second piping system 7 is especially designed separately or differently from the first piping system 6, although both systems 6, 7 are intercoupled. The piping systems 6, 7 can be, or are, designed and intercoupled so that in one extinguishing measure only inertising gas, only the 2-phase mixture or inertising gas at the same time can be introduced into the extinguishing volume 11 via the first piping system 6 and the 2-phase mixture can be introduced into the extinguishing volume 11 via the second piping system 7.

The coupling of the inert gas source 4, 5 to the second piping system 7 can especially be designed in such a way that a liquid-gas mixture with a predetermined mixing ratio can be introduced into the extinguishing volume 11. The mixing ratio can especially be adjusted in such a way that in the case of exclusive extinguishing with the liquid-gas mixture within the operating envelope the extinguishing concentration of extinguishing gas in the extinguishing volume 11 is not achieved. For example, a mixing point, a mixing chamber or a 2-phase mixing unit can be adjusted or designed so that in the extinguishant pipe connected downstream of the 2-phase mixing unit a turbulent 2-phase flow is formed and contains just enough extinguishing gas that the extinguishing concentration within the operating envelope is not achieved and therefore a satisfactory distribution of the extinguishing liquid or extinguishing water in the extinguishing volume 11 can be achieved.

A mixing point 17, a mixing chamber or mixing unit for producing the 2-phase mixture can be arranged in a piping segment between liquid extinguishant tank 2 and outlet openings 18 in the case of the proposed fire protection device 1, wherein the mixing point can preferably be arranged in the vicinity, more preferably in the direct vicinity, of the liquid extinguishant tank 2.

Overall, the second piping system 7, especially the connection or coupling between inert gas system and liquid extinguishant, is set up and designed in such a way that a 2-phase flow is formed in the pipe section which is connected downstream to the mixing point 17, the mixing chamber or the mixing unit.

As already mentioned, the thorough mixing of extinguishing gas and liquid extinguishant or extinguishing water at the mixing point can be carried out in such a way that a 2-phase flow, i.e. a flow consisting of extinguishant droplet, exists in the pipe section of the second piping system 7 connected downstream to the mixing point. This can be achieved by the quantity of extinguishing gas being reduced in comparison to known systems in such a way that the aforesaid condition is achieved, i.e. that the extinguishing concentration is not achieved. With a reduced quantity of extinguishing gas, the expansion coldness, which emanates from the compressed gas accumulator during expansion of the extinguishing gas and is introduced into the second piping system 7, can especially be reduced so that an ice build-up or icing up in the extinguishing water within the operating envelope can be avoided.

As a result of the concurrent possibilities of the pressurized introduction of the inert gas and the introduction of the 2-phase mixture into the space, a particularly efficient flame and/or fire fighting, which can be carried out with comparatively low use of extinguishant, can be achieved.

Especially by producing a 2-phase flow and feeding the 2-phase flow via the outlet openings into the space, or the spaces in question in each case, a comparatively good and fine distribution, atomization and misting of the liquid extinguishant can be achieved so that fire- and/or flame sources can be suppressed or combatted in a comparatively effective and efficient manner.

For establishing a suitable mixture consisting of liquid extinguishant and extinguishing gas, the fire protection device 1 in embodiments can comprise a corresponding open-loop and/or closed-loop control system which is, or are, designed for establishing a suitable mixing ratio in such a way that downstream of the mixing point a 2-phase flow is established in the second piping system. For establishing a suitable mixing ratio, specially designed nozzles for adjusting the liquid-gas mixture can especially be provided.

The proposed fire protection device 1 can be operated with comparatively low pressures in the region of between 8 and 30 bar in the piping system. With such pressures, the effect of a 2-phase flow of liquid extinguishant being formed in the second piping system 7 can especially be achieved. Apart from this, weight can be saved in piping systems and further components of the fire protection device 1 compared with systems which operate with significantly higher pressures (especially 100 bar and more). It may also be mentioned that the lower pressures require lower expenditure with regard to the bursting safety and the like.

Overall, it becomes apparent that the previously described fire protection device 1 offers the potential for a weight- and space optimized fire fighting which is especially suitable for use on board aircraft and other modes of transport.

In embodiments, the second branch pipe 13 can on the one hand be designed and equipped for applying pressure to the liquid extinguishant tank when in operation. To this end, a first branch pipe 14 of the second pipe branch 13 can be connected via a gas restrictor 15, for example a variable orifice, to the interior volume of the liquid extinguishant tank 2. The pressure application and the connection of the second pipe branch 13 to the liquid extinguishant tank 2 can especially be designed in such a way that when in use the liquid extinguishant 3 can be forced or pushed out of the liquid extinguishant tank 2.

On the other hand, the second pipe branch 13 can also be designed and equipped for providing inertising gas for the production of the 2-phase mixture or for feeding inertising gas to a mixing point 17, a mixing chamber or a mixing unit. In this case, the second pipe branch 13, especially a second branch pipe 16, can be connected via a second gas restrictor 15 to the mixing point 17. The mixing point 17, as already discussed further above, is connected downstream to the liquid extinguishant tank 2 and upstream to the outlet openings 18.

Via the gas restrictors 15, the mixing ratio between liquid extinguishant 3 and extinguishing gas at the mixing point can especially be adjusted or influenced. Via the gas restrictor 15, the volumetric or mass flow of liquid extinguishant 3 to the mixing point 17 can especially be adjusted, and the pressure and/or volumetric flow of the inertising gas to, or in, the mixing point 17 can be adjusted.

In embodiments, the inert gas source can comprise a compressed gas vessel, especially one or more compressed gas bottles 4, and/or an inert gas generating system provided on board the aircraft. The volume and/or the number of compressed gas vessels can be varied or correspondingly scaled depending on the requirements and conditions of the spaces which are to be provided with fire protection measures, such as spatial volume and duration of a fire fighting measure, leakage/air exchange rate and in dependence upon the performance of the inert gas generating system.

In the case of the proposed fire protection device 1, a two-stage or a 2-phase fire fighting procedure can especially be carried out.

In one extinguishing measure, by activating or opening one or more gas valves 20 of the compressed gas vessel(s), inertising gas, for example nitrogen, can be introduced via the first piping system 6 into the respective extinguishing volume 11 or the respective extinguishing volumes 11, as a result of which the oxygen content of the air can especially be reduced, for example reduced to a content of below 12% which lies above the extinguishing concentration. At the same time, the mixture consisting of liquid extinguishant and extinguishing gas can be introduced via the second piping system 7 in order to cool any fire- or flame sources below the ignition temperature. The time-based sequence of the extinguishing measures can be selected in accordance with the respective requirements. Both extinguishing measures can especially be initiated at the same time, and after the liquid extinguishant 3 has been consumed the introduction of extinguishing gas into the extinguishing volume(s) 11 can be continued in order to keep the concentration above the extinguishing concentration.

In variants, it can be provided that outlets of the compressed gas vessel 4 and of the inert gas generating system 5 are interconnected at a crossing point of the first piping system 6. In this way, the first piping system 6 and indirectly also the second piping system 7 can be supplied or pressurized with extinguishing gas both via the compressed gas vessel(s) 4 and via the inert gas generating system 5.

In further variants, it can be provided that the inert gas generating system 5 is protected in relation to the first piping system 6 by means of a check valve 22. In concrete terms, it can be provided that provision is made for the check valve 22 downstream of the inert gas generating system 5 and upstream of the crossing point so that a backflow of extinguishing gas or even liquid extinguishant 3 from the first piping system 6 and/or second piping system 7 to the inert gas generating system 5 can be prevented.

A reducing valve or a pressure reducer 21 which is designed for pressure adjustment of the extinguishing gas is preferably provided downstream of the compressed gas source 4. The reducing valve is preferably connected upstream to the crossing point 8 at which the compressed gas bottle(s) 4 and the inert gas generating system 5 are interconnected. A correspondingly constructed fire protection device 1 can especially meet the safety standards required in aircraft.

For activating the inert gas source, especially the compressed gas bottle 4 and/or the inert gas generating system 5, i.e. for connecting the inert gas source to the first and/or second piping system 6, 7 for feeding inertising gas, provision can be made in each case for automatic valves which in an emergency or when in operation enable a comparatively rapid connection of the inert gas source to the first and/or second piping system 6, 7. The automatic valves can especially be designed in such a way that in an emergency these can open automatically and/or can be opened by remote activation. The automatic valves can especially be pyrotechnic valves 20 which are especially also comparatively reliable over longer time periods.

In embodiments, at least one first switching- and distribution valve 12 can be provided between the gas outlet openings 10—which are provided for the introduction of the inertising gas into the space(s) 11—and the inert gas source 4, 5. The distribution valve 12 can be designed so that when in operation that or those gas outlet opening(s) 10, or that group of gas outlet openings 10, or that pipe section with one or more gas outlet openings 10, which are to be supplied with inertising gas, can be selectively chosen and connected.

In embodiments, it can be provided that a second switching- and distribution valve 19 is provided between the at least one outlet opening 18 and the liquid extinguishant tank 2. The second switching- and distribution valve 19 can be designed for selectively choosing and connecting when in operation that or those outlet opening(s) 18, or group of outlet openings 18, or a pipe section with one or more outlet openings 18, which are to be supplied with the 2-phase mixture.

The connecting of the gas outlet openings 10 and/or outlet openings 18 in embodiments can be designed in such a way that depending on the hazard situation when in operation fire fighting measures are initiated and conducted, especially automatically, in one or more areas of the aircraft by activating the proposed fire protection device 1.

It especially shows that the previously described fire protection device 1 and embodiments of this constitute an effective and efficient, and at the same time weight-optimized, fire protection system for aircraft, especially transport aircraft.

Using the proposed fire protection device 1, a method for fire fighting in one or more spaces of an aircraft can especially be conducted in accordance with the following description.

In one extinguishing measure, the 2-phase mixture consisting of liquid extinguishant 3 and inertising gas can be introduced via the outlet openings 18 into one or more spaces 11 of the aircraft which are affected by fire and/or flames.

At the same time, in a temporally staggered manner thereto or temporally consecutive manner, inertising gas, in a further extinguishing measure, can be introduced via the first piping system 6 and the gas outlet openings 10 into the space or the respective spaces.

With simultaneous introduction of the inertising gas via the first piping system 6 and of the 2-phase mixture via the second piping system 7, a comparatively fast fire fighting and fire suppression can especially be achieved. By the admission of inertising gas, especially nitrogen and/or another low-oxygen gas, via the first piping system 6 the oxygen content in the respective space can be lowered, e.g. lowered to less than 12%, so that the extinguishing concentration is achieved in order to prevent the process of combustion reactions. By introducing the 2-phase mixture, lowering of the temperature of flame- and fire sources below the ignition temperature inter alia can be achieved.

The method can especially be designed in such a way that the liquid-gas extinguishing measure can be extended over time periods of several minutes. The quantity of liquid extinguishant 3 and/or the quantity of provided inert gas is, or are, limiting factors for the duration of the liquid-gas extinguishing measure. The gas extinguishing measure can be designed so that the inertising atmosphere in the space or spaces can be maintained for up to several hours. In the gas extinguishing measure, the inert gas is preferably taken from the inert gas generating system 5, whereas in the liquid-gas extinguishing measure the inert gas is preferably taken from the compressed gas store 4.

By means of the proposed 2-stage or 2-phase method, a comparatively more effective and more efficient and also more potent fire protection on board aircraft can be achieved.

In embodiments of the method, the activation of the fire protection device 1 can be carried out by means of a pyrotechnic activation unit, e.g. the pyrotechnic valves 20.

In embodiments of the method, it can furthermore be provided that in a 2-phase mixing unit the liquid extinguishant 3 and the inertising gas are intermixed in such a way that in a pipe section of the second piping system, which is connected downstream to the 2-phase mixing unit, a 2-phase flow consisting of extinguishant droplets is formed in a volumetric flow consisting of inertising gas.

In variants, it can be provided that the 2-phase flow is generated in such a way that an average droplet size, i.e. average droplet diameter at the discharge point (outlet opening 18), in the region of between 10 and 100 μm is generated.

In embodiments of the method, it can be provided that a predetermined, essentially constant outlet pressure prevails or is established at the outlet openings 18 during the introduction of the 2-phase mixture. For example, the pressure can be within the region of between 8 and 15 bar or between 8 and 30 bar. By establishing a constant outlet pressure, a particularly advantageous, especially even, distribution of the extinguishant droplets in the respective spaces 11 can be achieved.

It especially shows that the proposed 2-stage method in combination with the fire protection device 1 which is also proposed herein offers a particularly effective and efficient way of fire fighting in aircraft.

Especially when using water as liquid extinguishant, a heater (not shown in the figures) can be installed for avoiding icing up or even the freezing up of the liquid extinguishant tank, for example during extended periods on the ground. The heater, if provided, is preferably designed in such a way that the tank volume can thaw out within a predetermined time period, for example in the region of 30 minutes. It would also be possible to add an anti-icing medium to the liquid extinguishant. A further alternative to avoid freezing up of the tank during extended periods on the ground is to couple the liquid extinguishant tank to the fresh water system in such a way that the liquid extinguishant tank can be emptied together with the fresh water before extended periods on the ground and can be replenished before start of flight, as a result of which freezing up can be avoided at least during extended periods on the ground.

Figure 2:
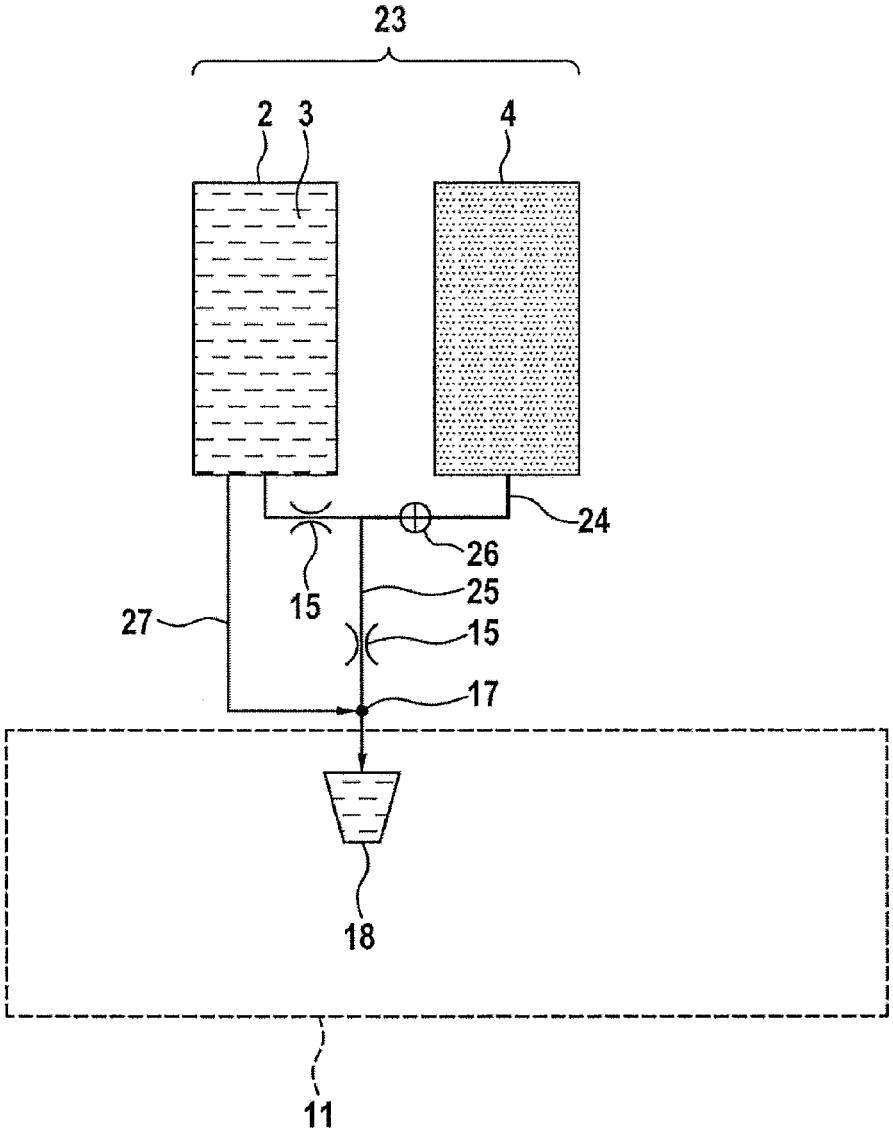
FIG. 2 shows a schematic construction of an exemplary embodiment of a wetting system proposed herein.

FIG. 2 shows a schematic construction of an exemplary embodiment of a wetting system proposed herein. The wetting system 23 comprises a liquid extinguishant tank 2 and a compressed gas bottle 4 which is designed for the pressurized provision of an extinguishing gas, especially an inert gas. In this case, reference is to be made to the fact that provision can also be made for a plurality of liquid extinguishant tanks 2 and/or a plurality of compressed gas bottles 4 which can especially be interconnected in each case.

The compressed gas bottle 4 is connected to the liquid extinguishant tank 2 via a first extinguishing gas pipe 24 and an interposed gas restrictor. In this way, the liquid extinguishant 3 contained in the liquid extinguishant tank 2 can be forced out of the liquid extinguishant tank 2, especially in a defined manner.

The compressed gas bottle 4 is connected via the first extinguishing gas pipe 24 and a second extinguishing gas pipe 25, branching therefrom, to an outlet opening 18. Optionally, a pressure regulator 26 can additionally be installed in the first extinguishing gas pipe 24 directly downstream of the compressed gas bottle. The liquid extinguishant tank 2 is connected to the mixing point 17 via an extinguishant pipe 27.

In the second extinguishing gas pipe 25, a gas restrictor 15 and a mixing point 17 are provided in series in the flow direction of the extinguishing gas. Via the two restrictors 15, the quantity or volumes of extinguishing gas and liquid extinguishant, which are fed to the mixing point, can be adjusted.

The wetting system 23 is scaled to a predetermined extinguishing volume, and the restrictors 15 and the mixing point 17 are especially designed in such a way that the extinguishing gas-to-liquid extinguishant ratio is set so that during an operation of the wetting system 23 within the operating envelope, i.e. with introduction of the 2-phase mixture into the extinguishing volume, i.e. into one or more spaces, the extinguishing concentration of extinguishing gas in the extinguishing volume is not achieved, i.e. the concentration of extinguishing gas remains below the extinguishing concentration. The advantages described further above especially result from this.

Figure 3:
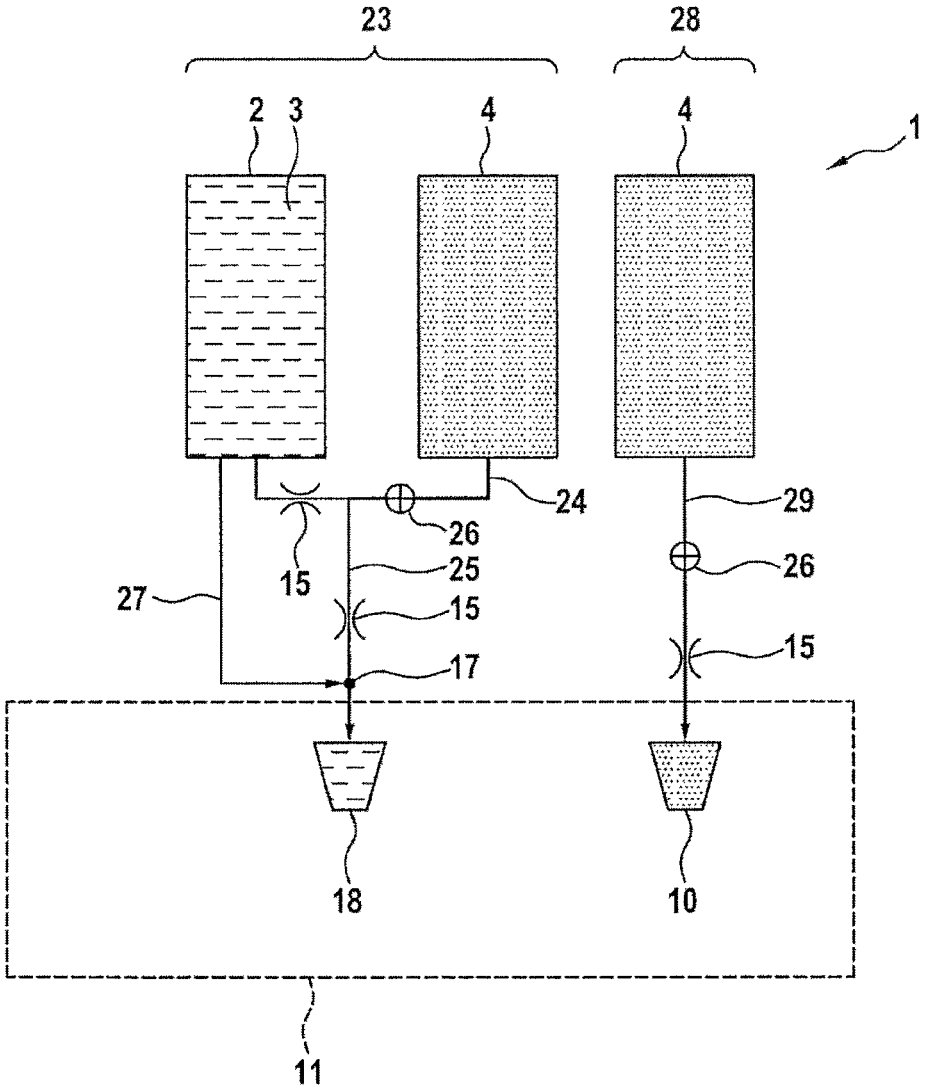
FIG. 3 shows a schematic construction of an exemplary second embodiment of fire protection device proposed herein, comprising the wetting system according to FIG. 2.

FIG. 3 shows a schematic construction of an exemplary second embodiment of a fire protection device 1 proposed herein, comprising the wetting system 23 according to FIG. 2. In addition to the wetting system 23 as described in FIG. 2, the fire protection device 1 furthermore comprises a gas extinguishing system 28 which is functionally coupled to the wetting system 23. As already described, the 2-phase mixture can be introduced into the space(s) 11 or into the extinguishing volume by means of the wetting system 23. On account of the comparatively small quantity of extinguishing gas which is added to the liquid extinguishant, especially in order to at least avoid icing up, the concentration of extinguishing gas in the liquid-gas extinguishing by means of the wetting system 23 is not achieved. In order to still achieve the extinguishing gas concentration, and also to maintain this after the liquid-gas extinguishing, provision is made for the gas extinguishing system 28 which is provided for introducing extinguishing gas into the space(s). By combining and functionally coupling the wetting system 23 with the gas extinguishing system 28, a particularly safe and reliable fire fighting can be achieved.

The gas extinguishing system 28 in the present example comprises a compressed gas bottle 4 which is connected via a third extinguishing gas pipe 29 to the gas outlet openings 10. Optionally, a pressure regulator 26 and/or a gas restrictor 15 can be provided between the outlet of the compressed gas bottle 4 and gas outlet openings 10.

Figure 4:
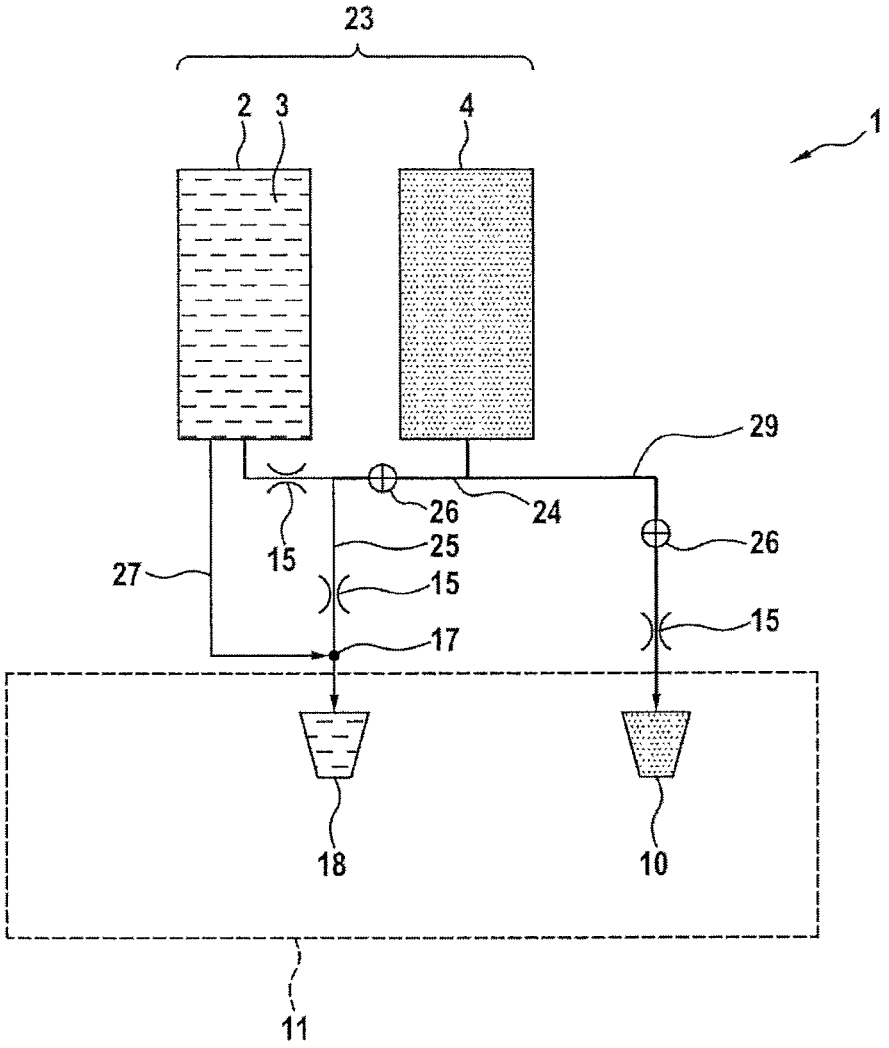
FIG. 4 shows a schematic construction of an exemplary third embodiment of a fire protection device proposed herein.

FIG. 4 shows a schematic construction of an exemplary third embodiment of a fire protection device 1 proposed herein. The fire protection device of the third embodiment differs from that of the second embodiment according to FIG. 3 in that the wetting system 23 and the gas extinguishing system 28 are fed in common from a compressed gas bottle 4, or optionally from a plurality of compressed gas bottles 4. In this case, the third gas pipe 29 is connected or coupled to the first extinguishing gas pipe 24. For adjusting the quantity or volume of extinguishing gas or liquid extinguishant which is fed to the mixing point 17, to the outlet opening 18 and to the gas outlet openings 10, the wetting system 23 can comprise a number of restrictors 15 and/or pressure regulators 26 in the first to third extinguishing gas pipes 24, 25, 29.

In the present exemplary embodiment, a pressure regulator 26 is connected upstream to the first extinguishing gas pipe 24, and in the first 24 and second extinguishing gas pipe 25 provision is made for restrictors 15 connected downstream to the pressure regulator 26. This arrangement and pipe routing corresponds to that according to FIG. 2 and FIG. 3.

In the gas extinguishing system 28, a pressure regulator 26 and/or a gas restrictor 15 can be optionally provided in the third extinguishing gas pipe 29 between the compressed gas bottle 4 or first extinguishing gas pipe 24 and the gas outlet openings 10. If both elements are provided, the gas restrictor 15 can be connected upstream to the pressure regulator 26 in the flow direction of the extinguishing gas.

Figure 5:
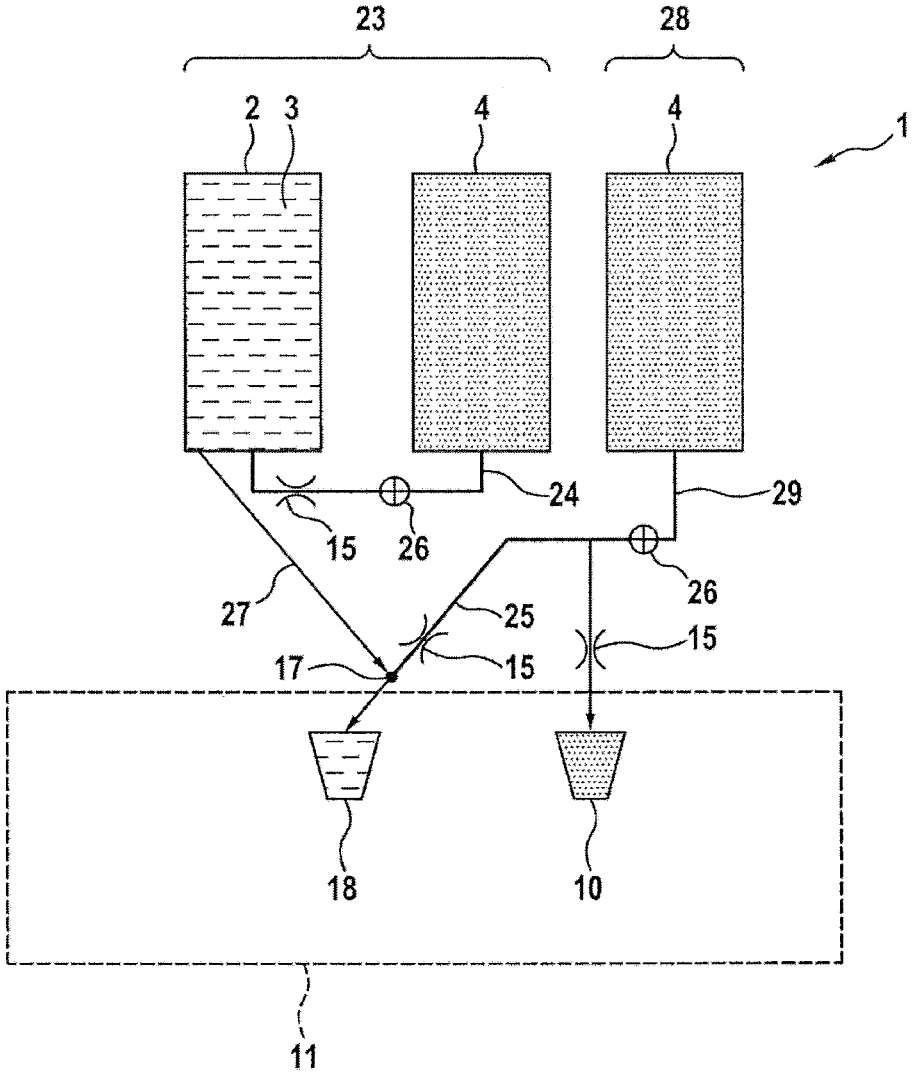
FIG. 5 shows a schematic construction of an exemplary fourth embodiment of a fire protection device proposed herein.

FIG. 5 shows a schematic construction of an exemplary fourth embodiment of a fire protection device 1 proposed herein. The fire protection device 1 according to the fourth embodiment, like the second and third embodiments, comprises a sub-unit working as a wetting unit 23 and a sub-unit working as a gas extinguishing system 28. The two sub-units correspond in their general function to the second and third embodiments. In the present embodiment, the two sub-units are intercoupled in the region of the gas-conducting pipes, which is described in more detail below.

The sub-unit working as a wetting unit 23 comprises a compressed gas tank 4 which via an optional pressure regulator 26 and via a gas restrictor 15 is connected to the liquid extinguishant tank 2 via the first extinguishing gas pipe 24. Instead of an individual compressed gas tank 4, a plurality of interconnected compressed gas tanks 4 can also be provided in the wetting unit 23. The liquid extinguishant tank 2 is connected via the liquid extinguishant pipe 27 to the mixing point 17 so that with pressurizing of the liquid extinguishant tank 2 with extinguishing gas from the compressed gas tank 4 of the wetting unit 23 the liquid extinguishant 3 can be fed to the mixing point 17.

The sub-unit working as a gas extinguishing system 28 comprises a compressed gas tank 4 for the pressurized storage and provision of extinguishing gas. Instead of the one compressed gas tank, a plurality of interconnected compressed gas tanks can also be provided. Connected downstream to the compressed gas tank 4 is a pressure regulator 26 from which on one side the gas outlet openings 10 are fed via an optional gas restrictor 15 and on the other side the mixing point 17 is fed via a gas restrictor 15. This means that the compressed gas tank 4 which is associated with the gas extinguishing system 28 is connected by means of different pipe branches both to the gas outlet openings 10 and to the mixing point 17, and feeds these with extinguishing gas when in operation.

The gas restrictors 15 and, if provided, the pressure regulators 26, are designed and equipped so that the effects according to the invention described further above are achieved, i.e. so that the liquid extinguishant-extinguishing gas-based extinguishing as such in the operating envelope does not lead to the extinguishing concentration for the extinguishing gas being achieved.

In the case of the embodiment according to FIG. 5, the gas outlet openings 10 and the mixing point 17 are fed with extinguishing gas at the same time. Consequently, with activation of the fire protection system 1, especially already with activation of the sub-unit already working as a wetting system 23, the supplying of the extinguishing volume, i.e. the space 11, with extinguishing gas from the gas outlet openings 10 and with the 2-phase mixture from the outlet openings 18 is carried out.

It especially becomes clear from the above description that the wetting system 23 proposed herein and a fire protection device 1 equipped therewith, and also the proposed method for fire fighting, achieve the object upon which the invention is based.

LIST OF DESIGNATIONS

1 Fire protection device
2 Liquid extinguishant tank
3 Liquid extinguishant
4 Compressed gas bottle
5 Device for inert gas generation
6 First piping system
7 Second piping system
8 Outlet
9 First pipe branch
10 Gas outlet opening

11 Extinguishing volume
12 First distribution valve
13 Second pipe branch
14 First branch pipe
15 Gas restrictor
16 Second branch pipe
17 Mixing point
18 Outlet opening
19 Second distribution valve
20 Pyrotechnic valve
21 Pressure reducer
22 Check valve
23 Wetting system
24 First extinguishing gas pipe
25 Second extinguishing gas pipe
26 Pressure regulator
27 Extinguishant pipe
28 Gas extinguishing system
29 Third extinguishing gas pipe

What is claimed is:

1. A wetting system for fire protection systems, wherein the wetting system is configured to wet a predetermined extinguishing volume with liquid extinguishant, the wetting system comprising:

a liquid extinguishant tank configured to store the liquid extinguishant, a compressed gas accumulator configured to store extinguishing gas in a pressurized state, and a piping system configured to introduce a mixture of the liquid extinguishant and the gas into the extinguishing volume through at least one discharge opening of the piping system, wherein the liquid extinguishant tank and compressed gas accumulator are interconnected through the piping system, wherein the liquid extinguishant tank and compressed gas accumulator feed a mixing point of the piping system, wherein the mixing point is configured to generate the liquid extinguishant-gas mixture, wherein the mixing point is provided in a segment of the piping system between the liquid extinguishing tank and the at least one discharge opening, wherein the piping system is configured, such that, in a liquid-gas extinguishing measure within a defined operating envelope, the concentration of extinguishing gas in the extinguishing volume remains below an extinguishing concentration, wherein the wetting system further comprises an additional piping system different from the piping system, wherein the additional piping system is connected to the compressed gas accumulator and provides a direct connection of the compressed gas accumulator to gas outlet openings;

wherein the additional piping system is configured for exclusively introducing extinguishing gas into the extinguishing volume through the gas outlet openings, and a first gas restrictor and a second gas restrictor, wherein the first gas restrictor is provided between the compressed gas accumulator and the liquid extinguishant tank and the second gas restrictor is provided between the compressed gas accumulator and the mixing point, such that the extinguishing gas pressure in the piping system is between 8 bar and 30 bar.

2. The wetting system according to claim 1, wherein the piping system further comprises a pressure limiting element, wherein the pressure limiting element is provided upstream of the mixing point and configured to adjust the pressure of the extinguishing gas, such that the concentration of extinguishing gas in the extinguishing volume, in the liquid-gas extinguishing measure within the operating envelope, remains below the extinguishing concentration.

3. The wetting system according to claim 2, wherein the pressure limiting element is configured, such that the extinguishing liquid-gas mixture has a composition consisting of 50 wt. % to 70 wt % of extinguishing liquid and 30 wt. % to 50 wt % of extinguishing gas.

4. The wetting system according to claim 1, wherein the compressed gas accumulator comprises at least two compressed gas tanks, wherein the piping system is fed from a first compressed gas tank and the additional piping system is fed from a separate, second compressed gas tank.

5. The wetting system according to claim 1, wherein the compressed gas accumulator comprises a plurality of interconnected compressed gas tanks which together feed the piping system, the liquid extinguishant tank and the additional piping system.

6. The wetting system according to claim 1, wherein the liquid extinguishant tank comprises a separate compressed gas accumulator for the pressurized introduction of the liquid extinguishant into the piping system.

7. A fire protection system comprising a wetting system according to claim 1.

8. The fire protection system according to claim 7, further comprising a gas extinguishing system which is configured to exclusively introduce extinguishing gas into the extinguishing volume, such that a fire-retarding extinguishing concentration of extinguishing gas is achieved in the extinguishing volume.

9. A method for fire fighting in an extinguishing volume in an aircraft, using a wetting system according to claim 1 or a fire protection system comprising the wetting system of claim 1, wherein, in one fire fighting measure, a liquid-gas mixture consisting of liquid extinguishant and extinguishing gas is introduced through a piping system into the extinguishing volume, wherein the introduction of the liquid-gas mixture is adjusted, such that, by the liquid-gas extinguishing within a defined operating envelope, the concentration of extinguishing gas in the extinguishing volume remains below the extinguishing concentration.

10. The method according to claim 9, wherein in a further fire fighting measure, which can proceed at the same time, in a temporally overlapping manner and/or temporally after the fire fighting measure, extinguishing gas is exclusively introduced via an additional piping system into the extinguishing volume.

11. The wetting system according to claim 1, wherein the second gas restrictor is provided upstream of the mixing point and configured to adjust the volumetric flow of the extinguishing gas, such that the concentration of extinguishing gas in the extinguishing volume, in the liquid-gas extinguishing measure within the operating envelope, remains below the extinguishing concentration.

12. The wetting system according to claim 11, wherein the second gas restrictor is configured, such that the extinguishing liquid-gas mixture has a composition consisting of 50 wt. % to 70 wt. % of extinguishing liquid and 30 wt % to 50 wt. % of extinguishing gas.

* * * * *